US005766210A

United States Patent [19]

Komoroczy et al.

[11] Patent Number: 5,766,210

[45] Date of Patent: Jun. 16, 1998

[54] MASSAGE DEVICE WITH MULTI-SURFACE HEAD AND METHODS FOR ITS USE

[75] Inventors: Lisa A. Komoroczy, Laguna Niguel; Peter V. Heller, San Clemente, both of Calif.

[73] Assignee: Geneva Holdings Co., Las Vegas, Nev.

[21] Appl. No.: 600,214

[22] Filed: Feb. 12, 1996

[51] Int. Cl.[6] ..... A61H 7/00

[52] U.S. Cl. ..... 601/135; 601/107; 601/121

[58] Field of Search ..... 601/134, 135, 601/107, 111, 118, 119, 120, 121

[56] References Cited

U.S. PATENT DOCUMENTS

| | | | |
|---|---|---|---|
| 998,328 | 7/1911 | Czinjak | 601/107 |
| 1,817,585 | 8/1931 | Samuel | 601/137 |
| 1,886,544 | 11/1932 | Hemp | 601/128 |
| 2,079,728 | 5/1937 | Arnold . | |
| 2,800,899 | 7/1957 | Barron . | |
| 3,672,358 | 6/1972 | Majewski . | |
| 4,532,919 | 8/1985 | Iwahashi et al. | 601/107 |
| 4,745,910 | 5/1988 | Day et al. | 601/107 |
| 4,878,489 | 11/1989 | Kamayachi . | |
| 4,883,047 | 11/1989 | Guitay . | |
| 4,989,585 | 2/1991 | Auker . | |
| 5,044,626 | 9/1991 | Parker, Jr. | 601/135 |
| 5,134,008 | 7/1992 | Alm . | |
| 5,143,056 | 9/1992 | Yih-Jong | 601/121 |
| 5,213,007 | 5/1993 | Yoo . | |

FOREIGN PATENT DOCUMENTS

| | | | |
|---|---|---|---|
| 476466 | 5/1929 | Germany | 601/107 |
| 231147B | 7/1944 | Switzerland | 601/107 |
| 172215 | 12/1921 | United Kingdom | 601/107 |

OTHER PUBLICATIONS

"Akura—List of Products", *Acura—Hemo Sapiens, Inc.*, brochure, 2 pages.

"Goosebumps", *Goosebumps Products, Inc.*, Copyright 1990, copy of two-sided package.

"Goosebumps", *Goosebumps Products, Inc.*, instruction booklet, 2 pages.

"Bonger News", *Bongers*, vol. 1, No. 5, 2 pages.

"Bonger", *Bongers*, instruction booklet, 2 pages.

"Chinese Massage Set", *Signals* catalog, item I. #44745, p. 27.

*Primary Examiner*—Michael A. Brown
*Assistant Examiner*—Benjamin K. Koo
*Attorney, Agent, or Firm*—Townsend and Townsend and Crew LLP

[57] ABSTRACT

The invention provides devices and methods for therapeutically treating a variety of body parts. An exemplary massage device comprises an elongate shaft having a proximal end and a distal end. A head is attached to the distal end of the shaft and includes a plurality of surface for interaction with a body part. At least two of the surfaces on the head each include a plurality of resilient knobs which are distributed over their surfaces. The knobs on one of the two surfaces are different from the knobs on the other surface. A handle is removably attached to the proximal end of the shaft.

41 Claims, 9 Drawing Sheets

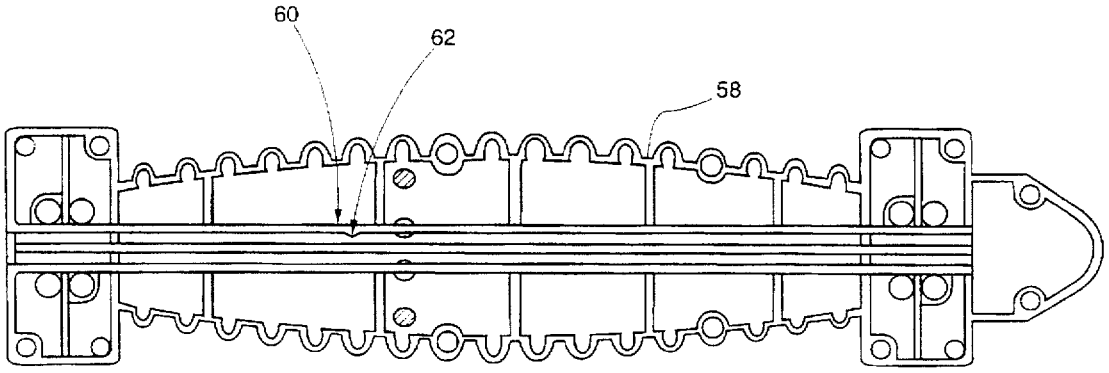
FIG - 16
FIG - 18
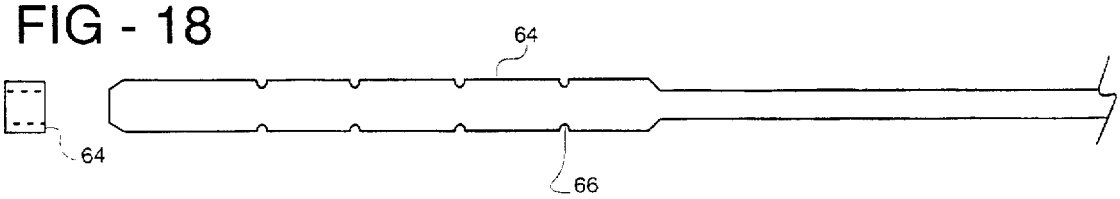
FIG - 17

MASSAGE DEVICE WITH MULTI-SURFACE HEAD AND METHODS FOR ITS USE

BACKGROUND OF THE INVENTION

The invention relates generally to the field of massage therapy, and more particularly to massage devices and methods for their use. In one particular aspect, the invention relates to a multi-faceted massage device useful in performing a variety of therapeutic treatments.

Massage therapy is a popular way to treat a variety of ailments including sore or tired muscles, headaches, minor scratches, stress, poor blood circulation, and the like. A variety of methods and devices for providing massage therapy have been proposed including manually performed hand massages, acupressure devices, vibrating massaging devices, massage balls, and the like. While some of these devices and methods may be useful in some respects, such devices and methods are usually specifically tailored for narrow applications. Hence, for an overall massage therapy treatment, a variety of such devices may often need to be employed. This in turn can increase the expense of a therapeutic treatment, and can require the maintenance and storage of numerous devices. Furthermore, some of such devices and methods may be difficult to use and may not provide adequate therapy. For example, manual hand massages usually require treatment from another person. Attempts to manually massage one's own self are often inconvenient and do not allow for treatment of difficult to reach areas. As a further example, some devices are tailored only for a specific area or application and will not provide adequate therapy if used elsewhere.

Hence, for these and other reasons, it would be desirable to provide devices and methods which would overcome or greatly reduce these and other problems. In particular, it would be desirable to provide a device and methods which would be effective in providing a wide variety of therapeutic treatments including massage, acupressure, soothing tired muscles, relieving headaches, soothing scratches, relieving stress, improving blood circulation, and the like. Such a device should be easy and convenient to use and be easy to store. It would further be desirable if such a device were relatively inexpensive so that a variety of therapeutic procedures may be performed with minimal expense.

SUMMARY OF THE INVENTION

The invention provides devices and methods useful in providing a wide variety of therapeutic treatments. In one exemplary embodiment, a massage device is provided which includes an elongate shaft having a proximal end and a distal end. A head is attached to the distal end of the shaft and includes a plurality of surfaces for interaction with a body part. At least two of the surfaces each include a plurality of resilient knobs. The knobs are configured such that the knobs on one of the two surfaces are different from the knobs on the other surface. In this manner, each surface may be employed to provide a different therapeutic treatment. A handle is removably attached to the proximal end of the shaft so that the handle may be removed and employed for other therapeutic treatments.

In one particular aspect, at least some of the knobs are tapered in geometry. In another aspect, the knobs on at least one of the surfaces are angled relative to each other, preferably being angled in the range from about 5° to about 45°. In still a further aspect, the number of knobs on each surface is in the range from about 4 to about 25. In this manner, different numbers of knobs may be included on each surface to provide for different therapeutic treatments depending upon which of the surfaces are employed. For example, a massage face may include approximately 20 knobs and may be employed to improve blood circulation when struck against a body part. As another example, one of the surfaces may include approximately 12 knobs and be employed to relieve muscle soreness. In still another example, a surface may include approximately six knobs which are arranged in two rows. The rows are sufficiently spaced apart so that they will straddle the spine. In this way, the knobs may be employed to relieve back stress when translated along the back straddling the spine.

In yet another aspect, the knobs may be constructed to be sufficiently resilient so that they will deflect when pressed against a body part with a prescribed force. One exemplary configuration of the knobs is to construct them of an elastomeric material having an A shore hardness in the range from about 40 to about 60. In still another aspect, at least one of the surfaces is provided with a curved geometry. For example, the surface may be spherical in geometry and have a smooth morphology. Such a surface may be employed to break down muscle tension and stimulate circulation when struck against a body part. Preferably, the shaft will be flexible to assist in striking one of the interactive surfaces against a body part with minimal movement of the handle. In this way, therapy may be provided with minimal effort.

In one preferable aspect, the shaft is removably attached to the handle by a press- or snap-fit so that it may conveniently be removed from the shaft. The handle further includes a plurality of resilient knobs that are distributed about its periphery. The handle may also include a pair of flanges or similar elements that circumference the handle's periphery. In this manner, the handle may be removed from the rest of the device and rolled on a generally flat surface without engaging the knobs with the surface. Such a configuration allows a user to place his or her foot on the knobs and roll the handle over the surface to therapeutically treat the foot. The handle may also further include a rounded end which may be pressed into a body part to provide acupressure therapy.

The invention further provides an exemplary method for therapeutically treating a plurality of body parts. According to the method, a massage device is provided comprising a elongate shaft having a proximal end and a distal end. A head is attached to the distal end of the shaft and includes a plurality of surfaces. At least one of the surfaces includes a plurality of resilient knobs that are distributed over the surface. A handle is removably attached to the proximal end of the shaft and includes a plurality of resilient knobs distributed about its periphery. For therapeutic treatment, the handle is grasped and a first body part is struck with the resilient knobs on the head surface. To therapeutically treat another body part, the handle is removed and the resilient knobs on the handle are engaged with another body part. In this manner, the massage device may be employed to therapeutically treat a plurality of body parts by using the surfaces on the head or the resilient knobs on the handle. Such a method provides convenience to the user by allowing a single device to be used for a variety of therapeutic treatments.

In one aspect of the method, the resilient knobs on the head surface are deflected when struck against one of the body parts with a prescribed force. In another aspect, resilient knobs are included on a second one of the head surfaces so that the second head surface may be used to strike a body part simply by adjusting the orientation of the handle in a user's hand before swinging the handle.

Preferably, the resilient knobs on the second head surface differ in number, shape, size, and/or orientation from the resilient knobs on the first head surface. In still another aspect, at least some of the knobs are preferably angled relative to each other.

In one preferable aspect, the knobs on one of the surfaces are spaced apart sufficient to straddle a person's spine. In this manner, the device may be translated to move the knobs along a person's back while straddling the spine. A further therapeutic treatment may be provided to a user's hand simply by squeezing the handle knobs in the user's hand. Alternatively, the handle may be removed from the device and rolled between the palms and the fingers to treat the hand. In still another therapeutic treatment, the handle may be placed on a generally flat surface and a foot rolled over the knobs to stimulate and rejuvenate the foot. In still yet another aspect of the method, the proximal end of the handle is rounded and may be pushed into a body part, such as at various pressure points.

BRIEF DESCRIPTION OF THE DRAWINGS

FIG. 16 is a cross-sectional side view of an alternative handle for a massage device according to the present invention.

FIG. 17 is a side view of a proximal end of a shaft for receiving the handle of FIG. 16 according to the present invention.

FIG. 18 is an end view of the shaft of FIG. 17.

DETAILED DESCRIPTION OF THE SPECIFIC EMBODIMENTS

Figure 1:
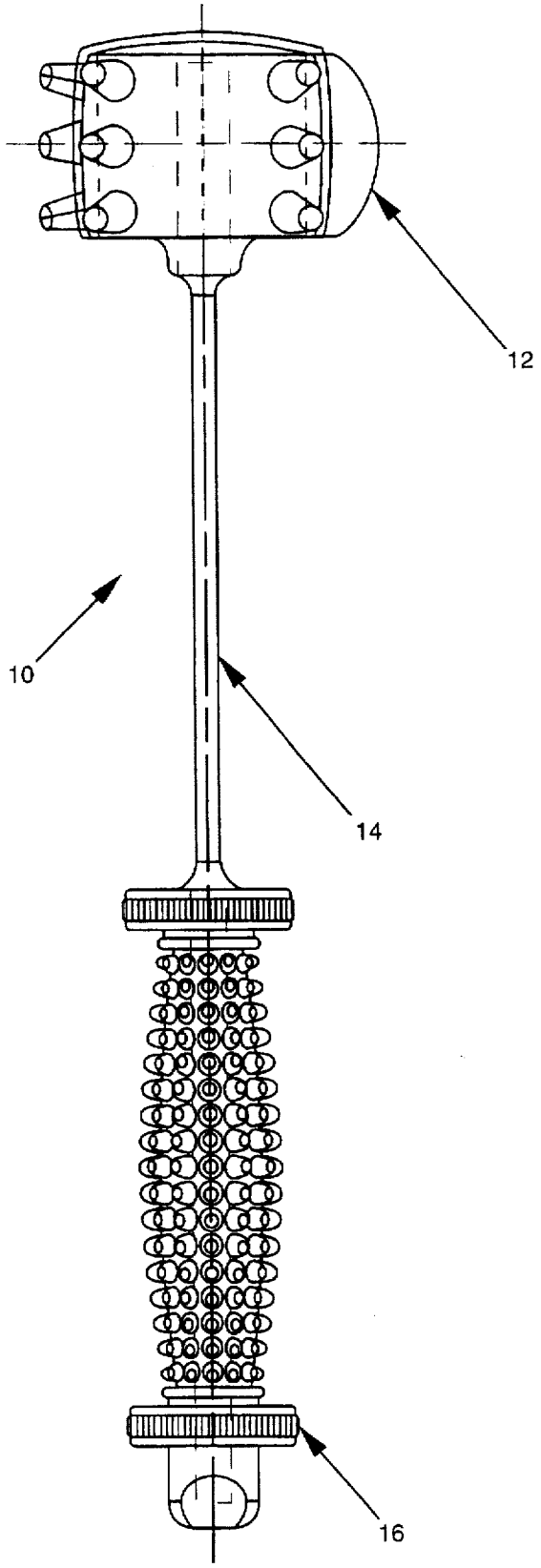
FIG. 1 is a side view of an exemplary massage device according to the present invention.

The invention provides devices and methods for therapeutically treating the body, and more particularly to a massage device which may be used to perform a wide variety of therapeutic treatments on various body parts. One exemplary embodiment of a massage device 10 is illustrated in FIG. 1. Device 10 comprises a head 12, a shaft 14, and a handle 16. Head 12 is preferably bonded or otherwise fixedly attached to shaft 14, while handle 16 is removably attached to shaft 14. Device 10 may be employed to therapeutically treat a patient by grasping handle 16 to manipulate portions of head 12 against a body part and/or by separately employing the handle 16 to treat a body part. Exemplary uses of the massage device 10 will be described in greater detail hereinafter.

Figure 2:
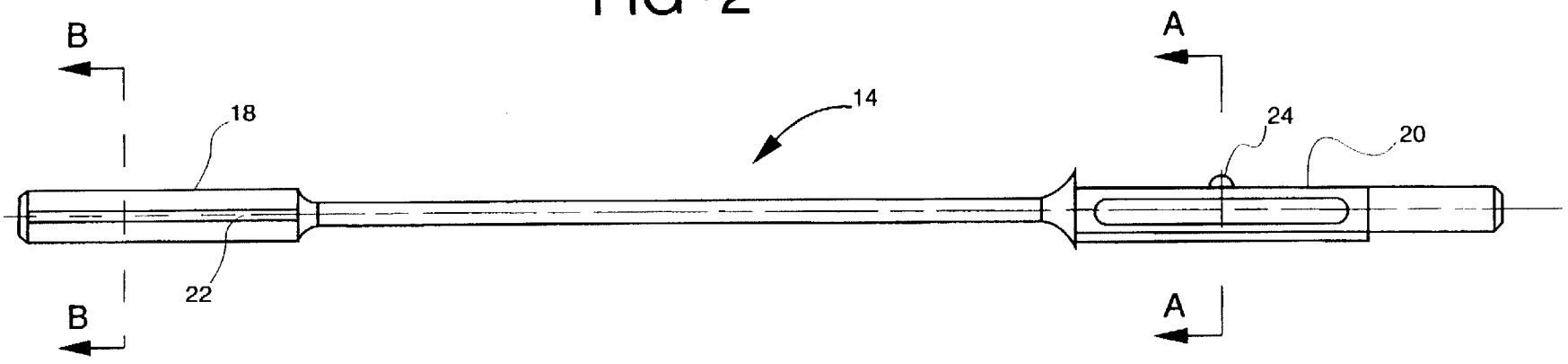
FIG. 2 is a side view of a flexible shaft of the massage device of FIG. 1.
Figure 2A:
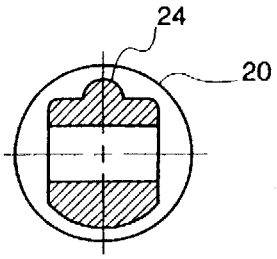
FIG. 2A is a cross-sectional view of the shaft of FIG. 2 taken along lines A—A.
Figure 2B:
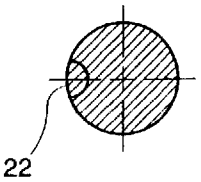
FIG. 2B is a cross-sectional view of the shaft of FIG. 2 taken along lines B—B.

Referring now to FIGS. 2, 2A, and 2B, construction of shaft 14 will be described in greater detail. Shaft 14 is preferably constructed of a flexible material, such as nylon, more preferably a Dupont material sold under the tradename of Zytel, so that head 12 will slightly swing relative to handle 16 when handle 16 is manipulated. Construction of shaft 14 in this manner allows for shaft 14 to flex in any direction depending on how handle 16 is manipulated. When constructed of nylon, shaft 14 may conveniently be formed by injection molding. Shaft 14 includes a distal end 18 and a proximal end 20. Shaft 14 is attached to head 12 by inserting distal end 18 into a lumen 38 (see FIG. 6A) of head 12. A bonding material may be employed to securely attach shaft 14 to head 12. Alternatively, head 12 may be attached to shaft 14 by a variety of methods, including a snap-fit connection, a threaded connection, an integral connection, and the like. Distal end 18 includes a groove 22 which may be employed as a vent when pressing shaft 14 into head 12. The distance between head 12 and handle 16 will preferably be in the range from about 5 inches to 8 inches.

Figure 5:
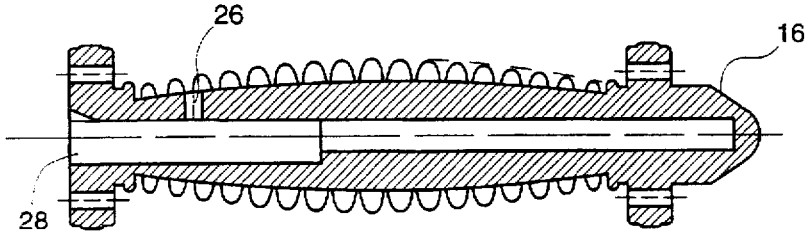
FIG. 5 is a cross-sectional view of the handle of FIG. 4.

Proximal end 20 is configured to snap-fit within handle 16. In this way, handle 16 may easily be removed from shaft 14 by pulling them apart. More specifically, proximal end 14 includes a detent 24 which will snap-fit into a hole 26 (see FIG. 5) in handle 16 when proximal end 20 is inserted into a central aperture 28 in handle 16. As best shown in FIG. 5, central aperture 28 corresponds in geometry, i.e. is keyed, with proximal end 20 so that when the proximal end 20 is fully inserted into central aperture 28, handle 16 will not translate or rotate relative to shaft 14. As shown in FIG. 2A, portions of proximal end 20 may include voids to reduce the amount of material needed to construct shaft 14. In this manner, manufacturing costs can be greatly reduced.

Although the connection between handle 16 and shaft 14 has been described as a snap-fit, it will be appreciated that other connections are possible, including threaded connections, press-fit connections, detent connections, and the like. One such alternative connection will be described hereinafter in connection with FIGS. 16–18.

Figure 3:
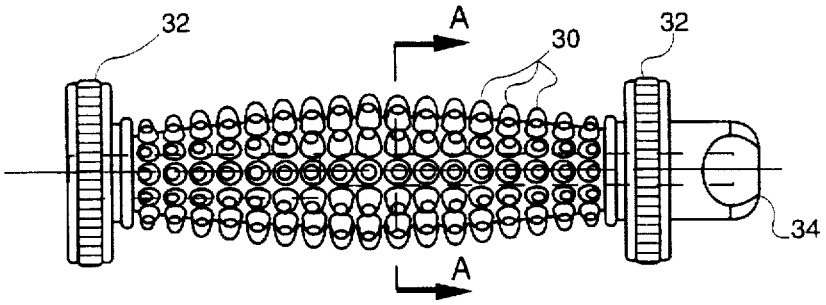
FIG. 3 illustrates a handle of the massage device of FIG. 1.
Figure 4:
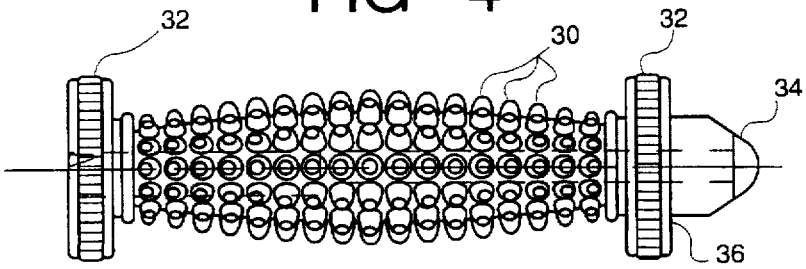
FIG. 4 is a side view of the handle of FIG. 3 rotated 90°.

Referring now to FIGS. 3–5, construction of handle 16 will be described in greater detail. Handle 16 is preferably constructed of an resilient material, such as polypropylene, and will usually have a length in the range from about 4 inches to 7 inches, and more preferably at about 5 inches. Handle 16 includes a plurality of resilient knobs 30 which are distributed about its periphery. Knobs 30 are sufficiently flexible so that they will yield when pressed against a body part. For example, when handle 16 is grasped with a hand, knobs 30 will slightly yield to provide a therapeutic massage treatment to the hand. Although the number, size, and orientation of knobs 30 may vary, for many applications it is desired to have at least 100 knobs which would have lengths in the range from about 0.4 inch to about 0.8 inch, and more preferably at about 0.6 inch. The knobs 30 also slightly taper as they extend radially away from handle 16. The handle 16 will preferably have a diameter in the range from about 0.7 inch to 1.1 inch, and more preferably at about 0.9 inch, as measured from knob to knob.

Figure 3A:
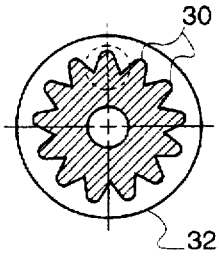
FIG. 3A is a cross-sectional view of the handle of FIG. 3 taken along lines A—A.

Handle 16 further includes a pair of flanges 32 near each end. Flanges 32 preferably have a diameter that is greater than the knob-to-knob diameter of handle 16 as illustrated in FIG. 3A. In this manner, when handle 16 is removed from shaft 14, handle 16 may be rolled on a flat surface without engaging knobs 30 with the flat surface. Such a feature is particularly useful when massaging a user's foot as described in greater detail hereinafter.

Handle 16 further includes a rounded knob or tip 34 at a proximal end 36. Tip 34 is constructed to simulate a clenched middle finger knuckle which is often used by massage therapists. In this manner, tip 34 may be engaged with a body part to perform various therapeutic functions as described in greater detail hereinafter.

Figure 6:
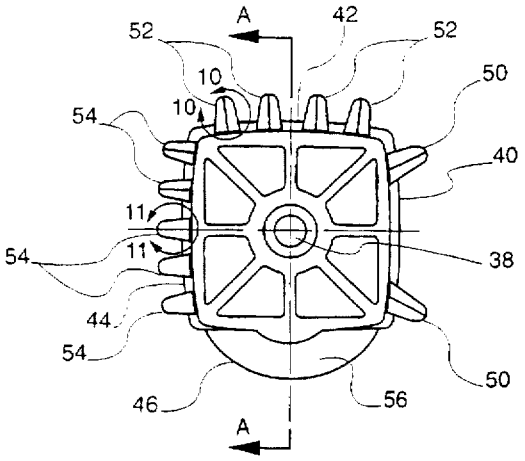
FIG. 6 is a bottom view of a head of the massage device of FIG. 1.
Figure 6A:
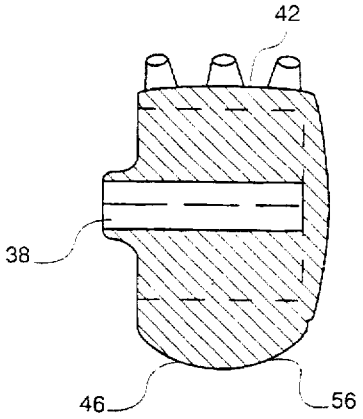
FIG. 6A is a cross-sectional view of the head of FIG. 6 taken along lines A—A.
Figure 7:
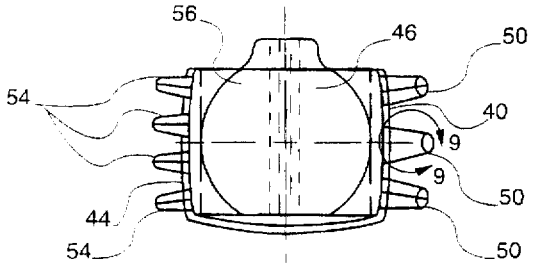
FIG. 7 is side view of the head of FIG. 6.
Figure 8:
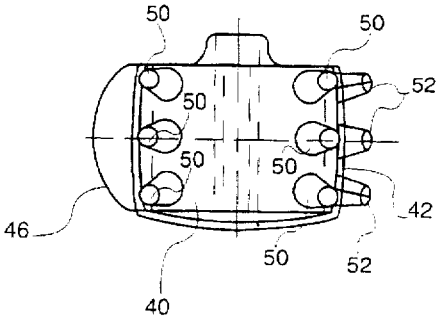
FIG. 8 illustrates the head of FIG. 7 rotated 90°.
Figure 9:
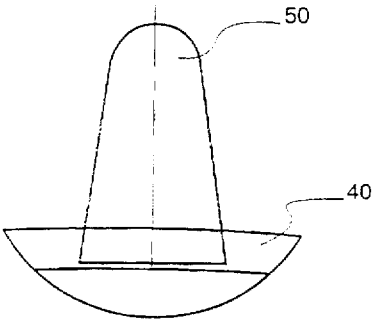
FIG. 9 illustrates a more detailed view of a knob on the head of FIG. 7 taken along lines 9—9.

Referring to FIGS. 6–8, construction of head 12 will be described in greater detail. As best shown in FIGS. 6 and 6A, head 12 includes a lumen 38 for receiving distal end 18 of shaft 14. Head 12 further includes four interactive surfaces 40, 42, 44, and 46 for interacting with various body parts. Interactive surfaces 40–46 are adapted to include a variety of therapeutic elements, such as knobs, rounded surfaces, and the like so that device 10 may be employed to provide a variety of therapeutic treatments depending upon which of the interactive surfaces is employed. It will be appreciated that the number, size, configuration and orientation of knobs on the interactive surfaces 40–46 (which include knobs) may vary depending upon the particular application.

One exemplary configuration of interactive surfaces 40–46 is illustrated in head 12 of FIGS. 6–8. Each of interactive surfaces 40–46 is preferably constructed of an elastomeric material, preferably having an A shore hardness in the range from about 40 to about 60. In this way, knobs which are included on any of the surfaces will be sufficiently resilient to deflect when struck against a body part. Each of interactive surfaces 40–46 is also preferably curved to both provide an aesthetically pleasing appearance and to assist in angling some of the knobs on the surfaces relative to each other.

As best shown in FIGS. 6 and 7–9, surface 40 is provided with six knobs 50 which are arranged in two rows. The two rows are sufficiently spaced apart, usually at least about 2 inches, so that the two rows of knobs 50 will straddle a person's spine. Further, each of the rows of knobs preferably diverge relative to each other so as to apply a spreading action to tissue which is impacted with knobs 50. Preferably, the knobs of one row will be angled relative to the knobs of another row in the range from about 35° to about 45°.

Figure 10:
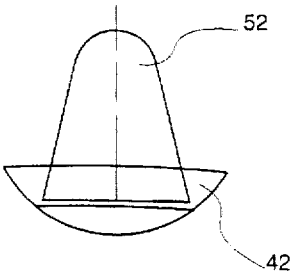
FIG. 10 is a more detailed view of a knob of the head of FIG. 6 taken along lines 10—10.

Interactive surface 42 includes twelve knobs 52 as illustrated in FIGS. 6, 8 and 10. Knobs 52 are smaller in size than knobs 50 and are spaced closer together. Knobs 52 are angled relative to each other due to the curvature of surface 42. Usually, knobs 52 will diverge from each other at a maximum angle in the range from about 5° to about 30° to assist in spreading tissue when impacted with knobs 52. Knobs 52 are particularly advantageous in massaging sore muscles located virtually anywhere on the body. When including about 12 knobs on a particular surface, the knobs will sufficiently flex to give the feeling of a "soft" surface when struck against body parts.

Figure 11:
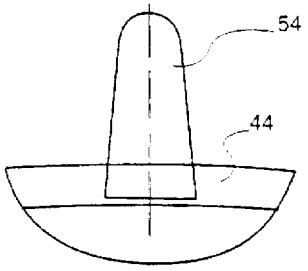
FIG. 11 is a more detailed view of a knob of the head of FIG. 6 taken along lines 11—11.

As best shown in FIGS. 6, 7, and 11, surface 44 includes a plurality of knobs 54 being twenty in number. Knobs 54 diverge away from each other at a maximum angle in the range from about 5° to about 30°. Providing about twenty knobs 54 on surface 44 allows device 10 to be used as a circulation tool for improving local blood circulation. As surface 44 is struck against the skin, the skin is stimulated to improve blood flow. Further, knobs 54 may also be employed to relieve temporary external itching or for soothing a scratch. Since head 12 may be manipulated by handle 16, knobs 54 may be placed at difficult to reach areas to provide such treatment.

Figure 7A:
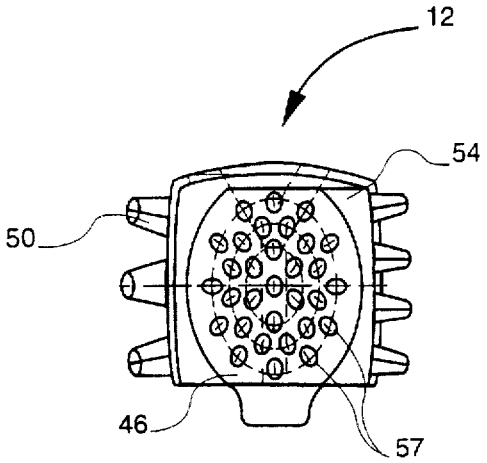
FIG. 7A illustrates the head of FIG. 7 having a plurality of mass reducing holes.
Figure 7B:
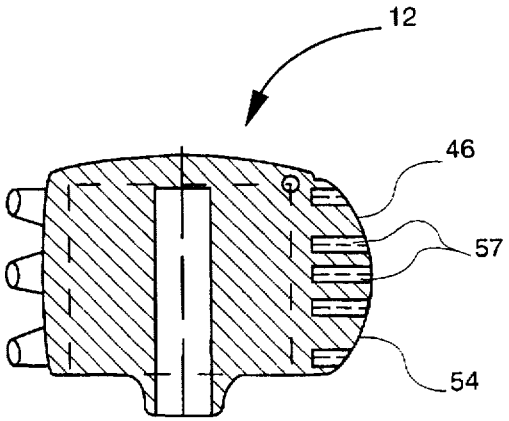
FIG. 7B is a cross sectional side view of the head of FIG. 7A.

As best shown in FIGS. 6–8, interactive surface 46 includes a spherical surface 56 which may be struck against a body part to provide therapy. When handle 16 is manipulated, shaft 14 flexes to place spherical surface 56 against a body part to help break down muscle tension and stimulate circulation. Flexing of shaft 14 allows for minimal hand movement while still providing a sufficient contact force between spherical surface 56 and the body part. As shown in FIGS. 7A and 7B, spherical surface 56 may optionally include a plurality of mass reducing holes 57 which serve the reduce the mass of head 12.

Hence, massage device 10 may function as a multi-faceted massage tool having an assorted variety of interactive surfaces including a multi-surfaced head, a removable handle with an interactive surface and a rounded tip. In this manner, a single device may be employed to perform a wide variety of therapeutic procedures to treat a variety of ailments. Such a device is easy to use, eliminates the clutter of employing several different therapeutic devices, and reduces therapy costs.

Figure 12:
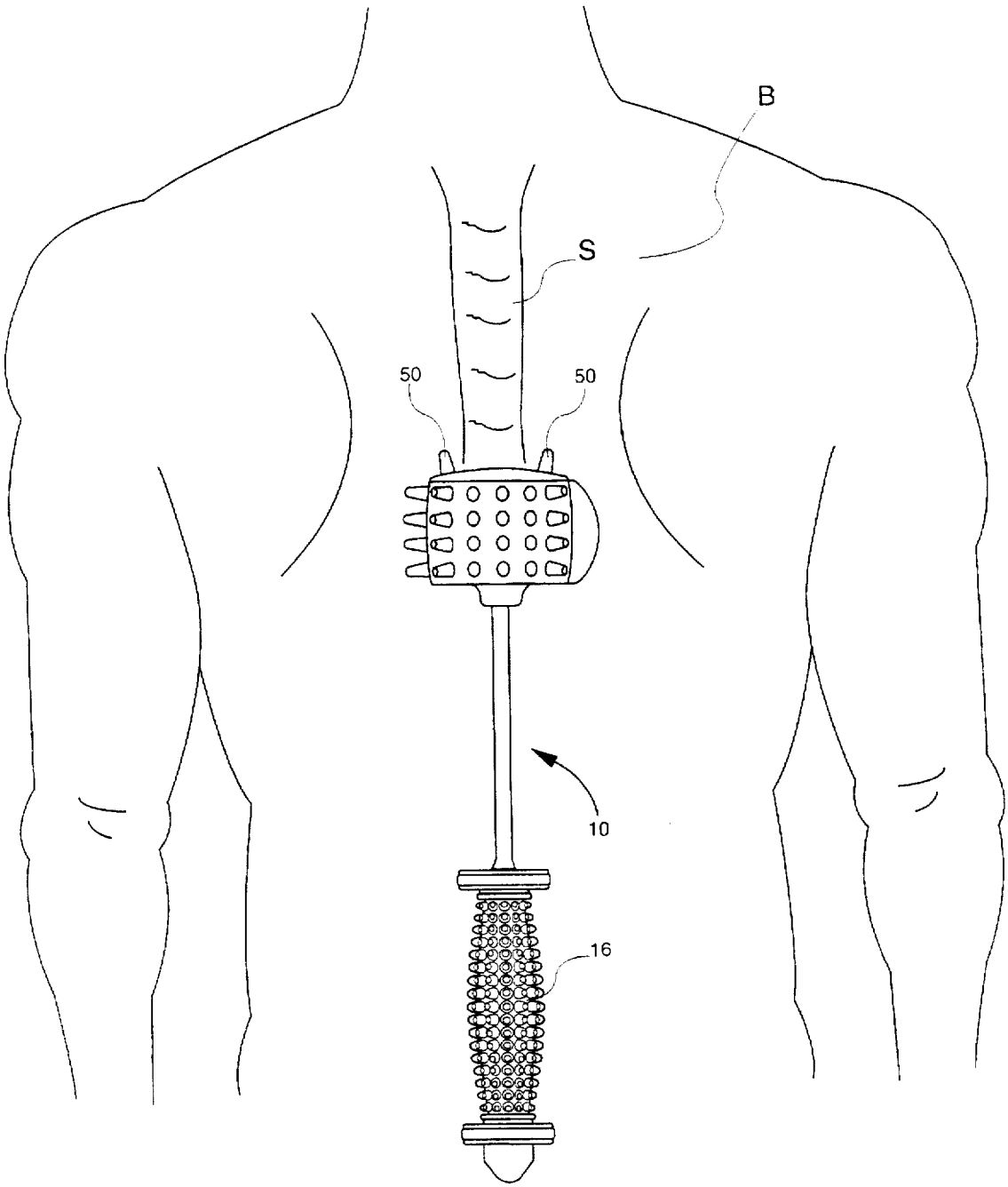
FIG. 12 illustrates an exemplary method for therapeutically treating a patient's back using the device of FIG. 1 according to the present invention.

Referring now to FIGS. 12–15, some exemplary uses of device 10 will be described. Referring first to FIG. 12, an exemplary method for therapeutically treating a patient's back B using device 10 will be described. Device 10 is initially grasped at handle 16 and is manipulated to place knobs 50 adjacent the back so as to straddle the person's spine S. While pressing downward, knobs 50 are moved down the person's back to massage and relieve tense muscles in the back surrounding the spine S. Other areas of the back B (as well as other body parts) may then optionally be treated by rotating handle 16 within the user's hand and engaging another one of the interactive surfaces with the back or other body part.

Figure 13:
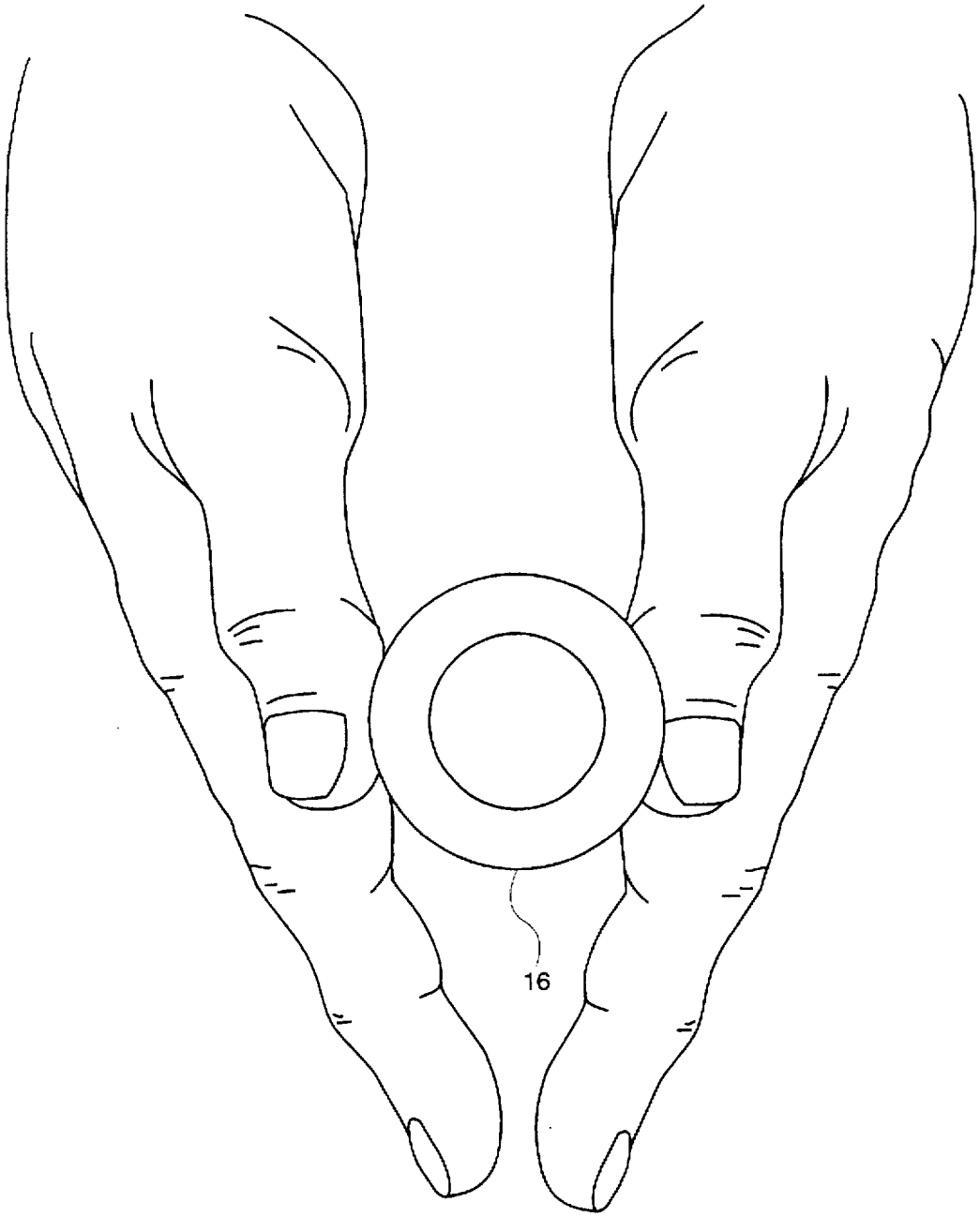
FIG. 13 illustrates an exemplary method for employing the handle of the device of FIG. 1 to therapeutically treat a patient's hands according to the present invention.

As best shown in FIG. 13, handle 16 may be employed to perform hand massage. Initially, handle 16 is removed from shaft 12 and is rolled between the palms and/or fingers of the hand. The knobs on handle 16 interact with the hand to relieve stress and tension in the hand. Such a method is particularly useful for people using a computer keyboard or a typewriter. Alternatively, hand massage may be performed by detaching handle 16 from shaft 12 and holding it in the palm of the hand while squeezing gently.

Figure 14:
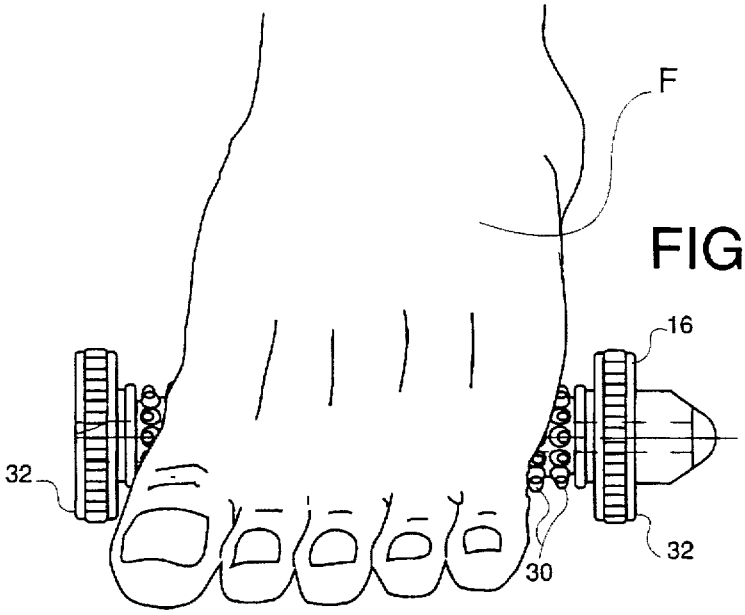
FIG. 14 illustrates an exemplary method for therapeutically treating a person's foot using the handle of the device of FIG. 1 according to the present invention.

FIG. 14 illustrates an exemplary method for foot massage using handle 16. After handle 16 is detached from shaft 12 it is placed on a flat surface such as a floor. While the person is standing or sitting, a foot F is placed on knobs 30 and the foot is rolled gently back and forth over the handle which rides on flanges 32. Resilient knobs 30 will tend to rejuvenate and relax tired and stressed feet.

Figure 15:
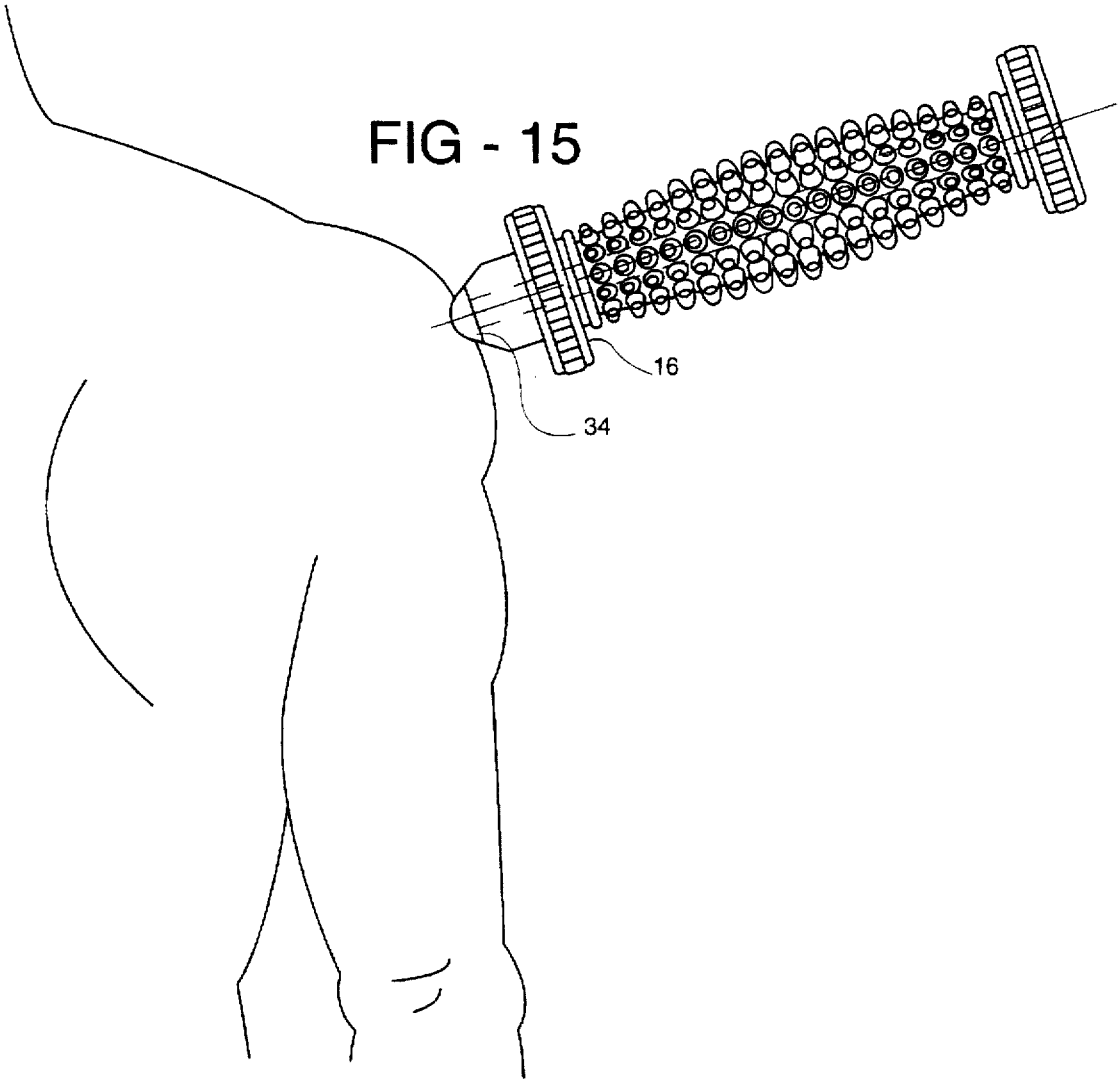
FIG. 15 illustrates an exemplary method for treating a body part using a rounded end of the handle of the device of FIG. 1 according to the present invention.

FIG. 15 illustrates use of rounded tip 34 on handle 16 to therapeutically treat a body part. Preferably, a pressure point will be located on the body and rounded tip 34 firmly pressed into the pressure point as shown. In this manner, rounded tip 34 simulates a middle knuckle of a massage therapist.

Although the invention has been described in great detail with reference to specific embodiments, it will be appreciated that certain changes and modifications may be made. For example, as illustrated in FIG. 16, device 10 may alternatively be provided with a handle 58 having a pawl 60 which may retract because of a notch 62. In this manner, when an alternative shaft 64 (see FIG. 17) is inserted into handle 58, a groove 66 will engage pawl 60. To disengage shaft 64 from handle 58, handle 58 and shaft 64 are pulled apart from each other to move pawl 60 out of engagement. As illustrated in FIG. 18, shaft 64 may be keyed to be rectangular in geometry so that it will properly align with the pawl 60 when inserted into handle 58.

Although the foregoing invention has been described in some detail by way of illustration and example, for purposes of clarity of understanding, it will be obvious that certain changes and modifications may be practiced within the scope of the appended claims.

What is claimed is:

1. A device comprising:

a flexible elongate shaft having a proximal end and a distal end;

a head attached to the distal end of the shaft, wherein the head includes a plurality of surfaces for interaction with a body part, and wherein at least two of the surfaces each include a plurality of resilient knobs distributed over their surfaces, with the knobs on one of the two surfaces being different from the knobs on the other surface; and a handle removably attached to the proximal end of the shaft, by an attachment mechanism which allows for selective engagement and removal of the shaft to and from the handle, wherein the handle may be manipulated to flex the shaft and cause the head to selectively swing in any direction relative to the handle to engage any of the surfaces against a body part.

2. A device as in claim 1, wherein at least some of the knobs are tapered in geometry.

3. A device as in claim 1, wherein the knobs one the surfaces are angled relative to each other in the range from about 5° to about 45°.

4. A device as in claim 1, wherein the number of knobs on each surface is in the range from about 4 to 25.

5. A device as in claim 1, wherein the knobs are constructed to have sufficient resilience so as to deflect when pressed against a body part with a prescribed force.

6. A device as in claim 5, wherein the knobs have an A Shore hardness in the range from about 40 to about 60.

7. A device as in claim 5, wherein the knobs are constructed of an elastomer.

8. A device as in claim 1, wherein the knobs on one of the surfaces differ in size from the knobs on another of the surfaces.

9. A device as in claim 1, wherein the knobs on one of the surfaces differ in number from the knobs on another of the surfaces.

10. A device as in claim 9, wherein the knobs on one of the surfaces are spaced-apart such that the knobs will straddle a person's spine.

11. A device as in claim 10, wherein the number of spaced-apart knobs comprises six.

12. A device as in claim 1, wherein at least one of the surfaces is convex in geometry.

13. A device as in claim 12, wherein at least one of the surfaces in spherical in geometry and has a smooth morphology.

14. A device as in claim 1, wherein the number of interactive surfaces on the head comprises four.

15. A device as in claim 1, wherein the proximal end of the shaft is removably attached to the handle by a detent snap-fit.

16. A device as in claim 1, wherein the handle includes a plurality of resilient knobs distributed about its periphery.

17. A device as in claim 16, wherein the handle includes a pair of flanges circumferencing the handle's periphery, wherein the handle may be rolled on a generally flat surface without engaging the knobs with the flat surface.

18. A device as in claim 1, wherein the handle includes a proximal end and a distal end, wherein the distal end of the handle is removably attached to the proximal end of the shaft, and wherein the proximal end of the handle is rounded, whereby the rounded distal end may be pressed into a body part.

19. A massage device comprising:

a flexible elongate shaft having a proximal end and a distal end;

a head attached to the distal end of the shaft, the head having a plurality of surfaces;

a handle having an aperture into which the proximal end of the shaft is removably received, wherein the handle further includes an attachment mechanism which allows for selective engagement and removal of the shaft to and from the handle, the handle having a plurality of resilient knobs distributed about its periphery; and at least a pair of flanges circumferencing the handle such that handle can be removed from the shaft and rolled on a generally flat surface without engaging the knobs, and wherein the handle may be manipulated to flex the shaft and cause the head to selectively swing in any direction relative to the handle to engage any of the surfaces against a body part.

20. A device as in claim 19, wherein at least one of the head surfaces is curved and includes a plurality of resilient knobs distributed over the curved surface for interaction with a body part.

21. A device as in claim 20, wherein at least some of the knobs on the head surface are tapered in geometry.

22. A device as in claim 20, wherein at least some of the knobs on the head surface are angled relative to each other in the range from about 5° to about 45°.

23. A device as in claim 20, wherein the number of knobs on the head surface is in the range from about 4 to 25.

24. A device as in claim 19, wherein the proximal end of the shaft is removably attached to the handle by a press fit.

25. A method for therapeutically treating a plurality of body parts, the method comprising:

providing a massage device comprising an elongate shaft having a proximal end and a distal end; a head attached to the distal end of the shaft, wherein the head includes a plurality of surfaces, and wherein at least one of the surfaces includes a plurality of resilient knobs distributed over the surface; and a handle removably attached to the proximal end of the shaft, with the handle including a plurality of resilient knobs distributed about its periphery;

grasping the handle and striking a first body part with the resilient knobs on the head surface; and removing the handle and engaging the resilient knobs on the handle with a second body part.

26. A method as in claim 25, wherein the resilient knobs on the head surface are deflected when struck against the first body part with a prescribed force.

27. A method as in claim 25, wherein resilient knobs are included on a second one of the head surfaces, and further comprising adjusting the orientation of the handle in a user's hand and striking a body part with the resilient knobs on the second head surface.

28. A method as in claim 27, wherein the resilient knobs on the second head surface differ in size from the resilient knobs on the first head surface.

29. A method as in claim 27, wherein the resilient knobs on the second head surface differ in number from the number of resilient knobs on the first head surface.

30. A method as in claim 25, wherein at least some of the knobs are angled relative to each other.

31. A method as in claim 25, wherein one of the surfaces includes knobs which are spaced-apart sufficient to straddle a person's spine, and further comprising translating the knobs along a person's back while the knobs straddle the spine.

32. A method as in claim 25, wherein the engaging step comprising squeezing the handle knobs in a user's hand.

33. A method as in claim 25, wherein the engaging step comprising rotating the handle to engage the handle knobs against a body part.

34. A method as in claim 33, wherein the rotating step comprises rolling the handle between a user's hands.

35. A method as in claim 33, wherein the rotating step comprises placing the handle on a generally flat surface and rolling a foot over the knobs on the handle.

36. A method as in claim 25, wherein the removing step comprises pulling the handle from the shaft.

37. A method as in claim 25, wherein a proximal end of the handle is rounded, and further comprising pushing the rounded end into a body part.

38. A device comprising:

an elongate shaft having a proximal end and a distal end;

a head attached to the distal end of the shaft, wherein the head includes a plurality of surfaces for interaction with a body part, and wherein at least two of the surfaces each include a plurality of resilient knobs distributed over their surfaces, with the knobs on one of the two surfaces being different from the knobs on the other surface; and a handle removably attached to the proximal end of the shaft, wherein the proximal end of the shaft is removably attached to the handle by a snap-fit.

39. A device comprising:

an elongate shaft having a proximal end and a distal end;

a head attached to the distal end of the shaft, wherein the head includes a plurality of surfaces for interaction with a body part, and wherein at least two of the surfaces each include a plurality of resilient knobs distributed over their surfaces, with the knobs on one of the two surfaces being different from the knobs on the other surface; and a handle removably attached to the proximal end of the shaft, wherein the handle includes a proximal end and a distal end, wherein the distal end of the handle is removably attached to the proximal end of the shaft, and wherein the proximal end of the handle is rounded, whereby the rounded distal end may be pressed into a body part.

40. A method for therapeutically treating a body part, the method comprising:

providing a massage device comprising an elongate flexible shaft having a proximal end and a distal end; a head attached to the distal end of the shaft, wherein the head includes a plurality of surfaces, and wherein at least one of the surfaces includes a plurality of resilient knobs distributed over the surface; and a handle operably attached to the proximal end of the shaft;

grasping the handle in a first orientation and moving the handle to cause the shaft to flex and the head to swing relative to the handle until striking the body part with one of the head surfaces;

grasping the handle in a second orientation and moving the handle to cause the shaft to flex and the head to swing relative to the handle until striking the body part with a different one of the head surfaces.

41. A method as in claim 40, further comprising removing the handle from the shaft and engaging the resilient knobs on the handle with another body part.

* * * * *